US006988334B2

(12) United States Patent
Kinsey

(10) Patent No.: US 6,988,334 B2
(45) Date of Patent: Jan. 24, 2006

(54) SASH TILT RESISTANCE CONTROL

(76) Inventor: Bruce F. Kinsey, P.O. Box 1936, Beaufort, SC (US) 29901-1936

( * ) Notice: Subject to any disclaimer, the term of this patent is extended or adjusted under 35 U.S.C. 154(b) by 0 days.

(21) Appl. No.: 10/244,123

(22) Filed: Sep. 16, 2002

(65) Prior Publication Data

US 2004/0049985 A1 Mar. 18, 2004

(51) Int. Cl.
*E05D 15/22* (2006.01)

(52) U.S. Cl. ..... 49/187

(58) Field of Classification Search ..... 49/159, 49/176, 163, 161.5, 187, 174, 386, 389; 52/200, 52/64

See application file for complete search history.

(56) References Cited

U.S. PATENT DOCUMENTS

| | | | | | |
|---|---|---|---|---|---|
| 1,734,836 | A | * | 11/1929 | Thomas | 49/155 |
| 1,832,058 | A | * | 11/1931 | Stewart | 49/172 |
| 1,902,973 | A | * | 3/1933 | Schoening | 49/187 |
| 1,980,275 | A | * | 11/1934 | Julin | 49/155 |
| 2,027,556 | A | * | 1/1936 | Seligman | 49/187 |
| 2,394,982 | A | * | 2/1946 | Carl | 49/155 |
| 2,796,639 | A | * | 6/1957 | Reynolds | 49/155 |
| 2,908,052 | A | * | 10/1959 | Jakush | 49/129 |
| 3,055,063 | A | * | 9/1962 | Peters | 49/174 |
| 3,118,190 | A | * | 1/1964 | Love | 49/174 |
| 3,124,849 | A | * | 3/1964 | Osten, Sr. | 49/174 |
| 3,126,588 | A | * | 3/1964 | Osten, Sr. | 49/174 |
| 3,146,501 | A | * | 9/1964 | Peters | 49/174 |
| 3,399,490 | A | * | 9/1968 | Hettinger | 49/414 |
| 3,600,855 | A | * | 8/1971 | Starck et al. | 49/51 |
| 4,141,403 | A | * | 2/1979 | Church | 160/201 |
| 4,935,987 | A | * | 6/1990 | Sterner, Jr. | 16/198 |
| 5,568,702 | A | * | 10/1996 | Frank et al. | 49/153 |
| 5,575,114 | A | * | 11/1996 | Riegelman | 49/246 |
| 5,581,941 | A | * | 12/1996 | Sill et al. | 49/246 |
| 5,697,188 | A | * | 12/1997 | Fullick et al. | 49/181 |
| 5,873,199 | A | * | 2/1999 | Meunier et al. | 49/181 |
| 6,431,620 | B2 | * | 8/2002 | Tremblay et al. | 292/263 |
| 6,460,294 | B1 | * | 10/2002 | Harkins | 49/345 |
| 6,523,307 | B2 | * | 2/2003 | Prete et al. | 49/445 |

* cited by examiner

*Primary Examiner*—Jerry Redman

(57) ABSTRACT

A window assembly with a frame and a sash mounted to tilt open relative to the frame includes a tilt control to prevent a free fall opening of the sash. The tilt control provides a resistance to the tilt opening of the sash. The sash applies a force on the tilt control as the sash is tilted open. The force increases the farther the sash is tilted open. The resistance provided by the tilt control also increases the farther the sash is tilted open to compensate for the increased force applied on the tilt control.

5 Claims, 7 Drawing Sheets

FIG. # 1.
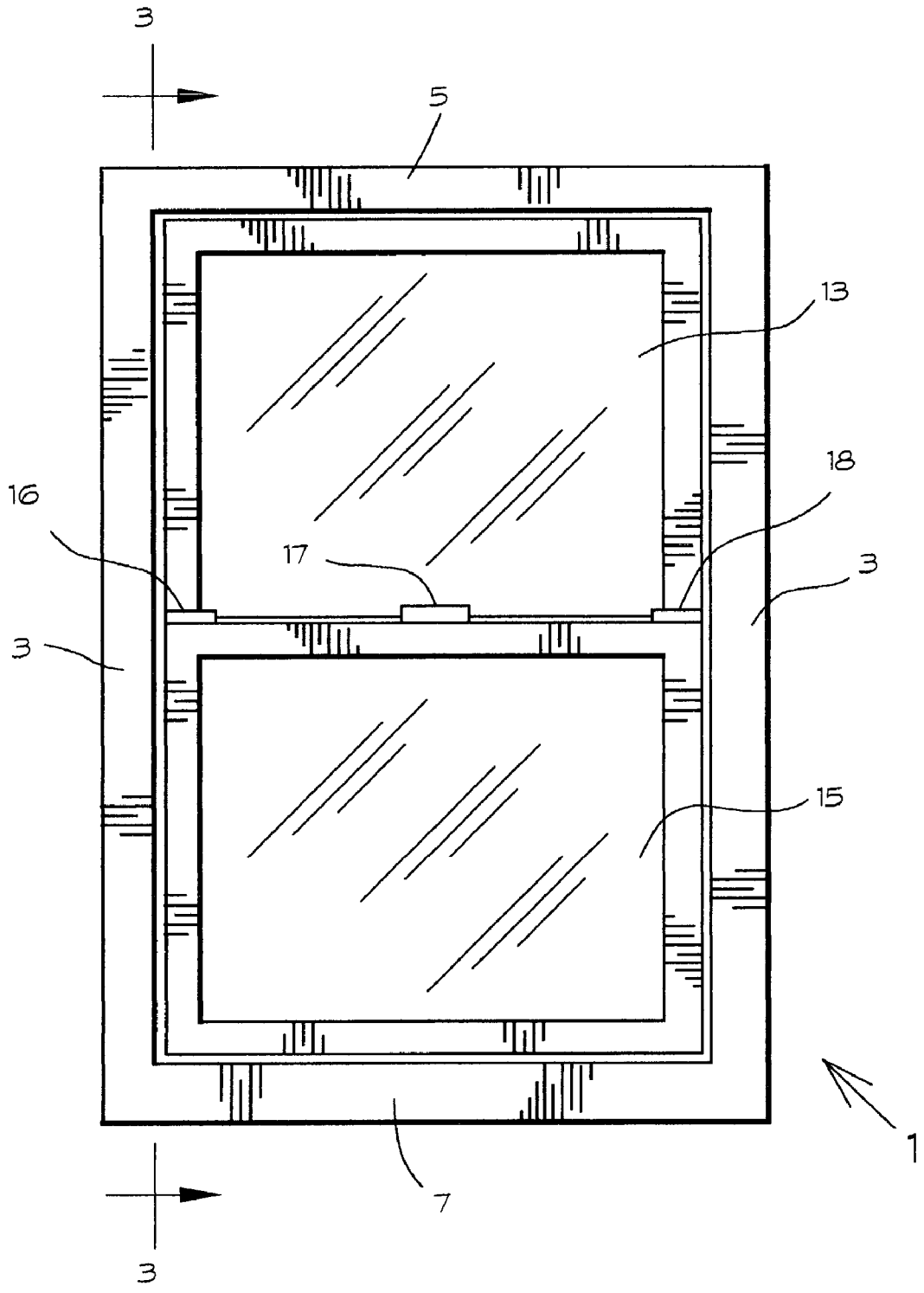

FIG. # 2.
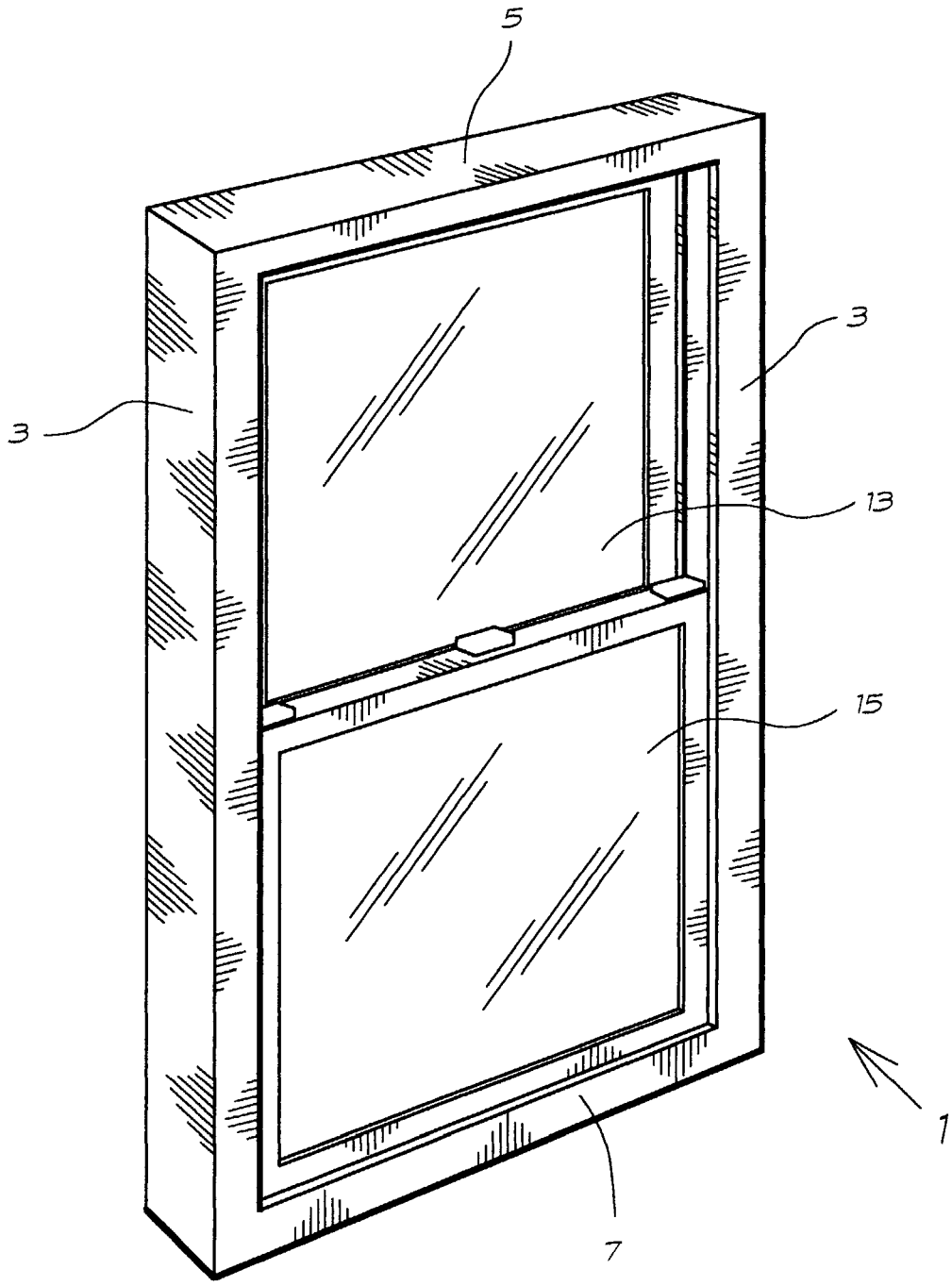

FIG. # 3.
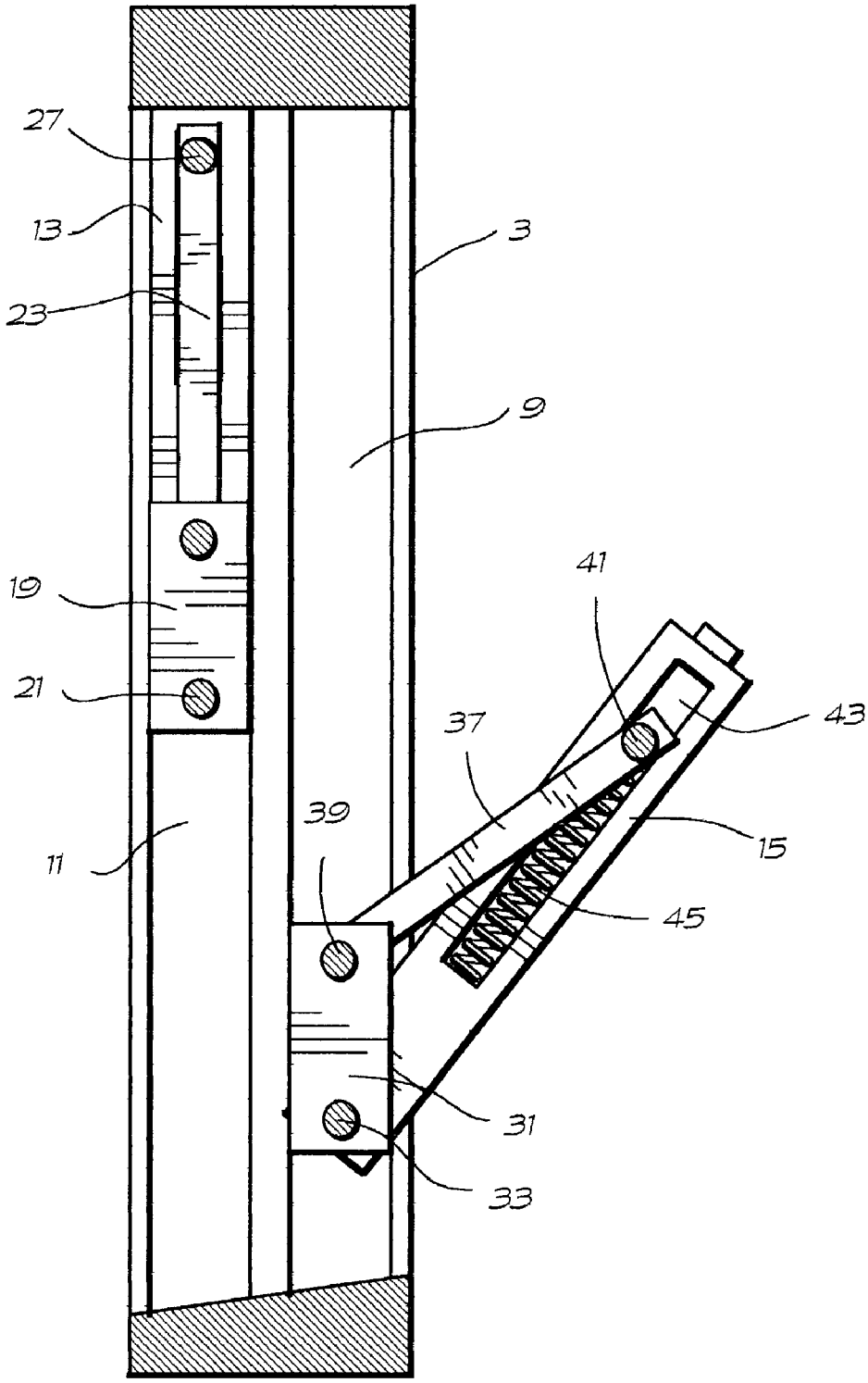

FIG. # 4.
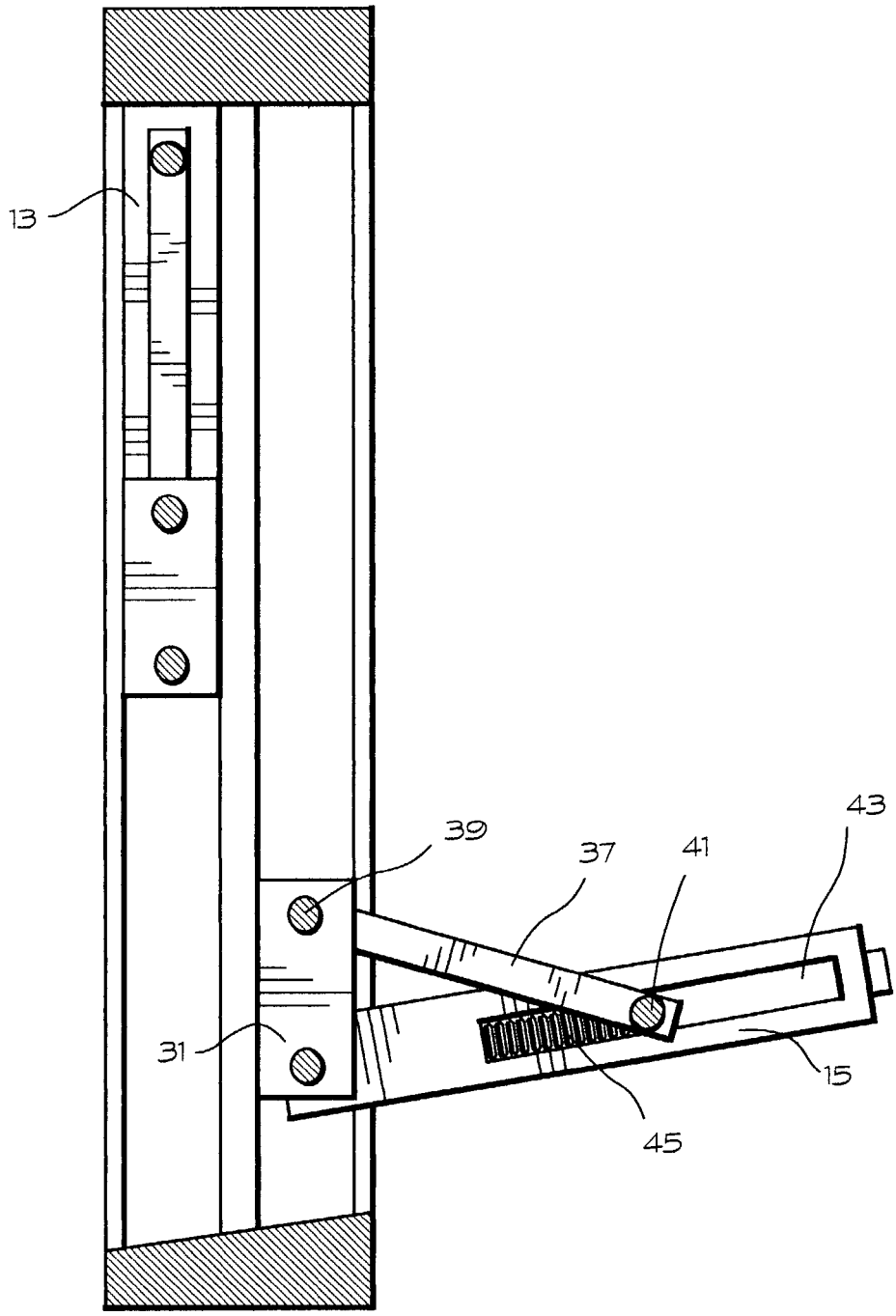

FIG. #. 5.
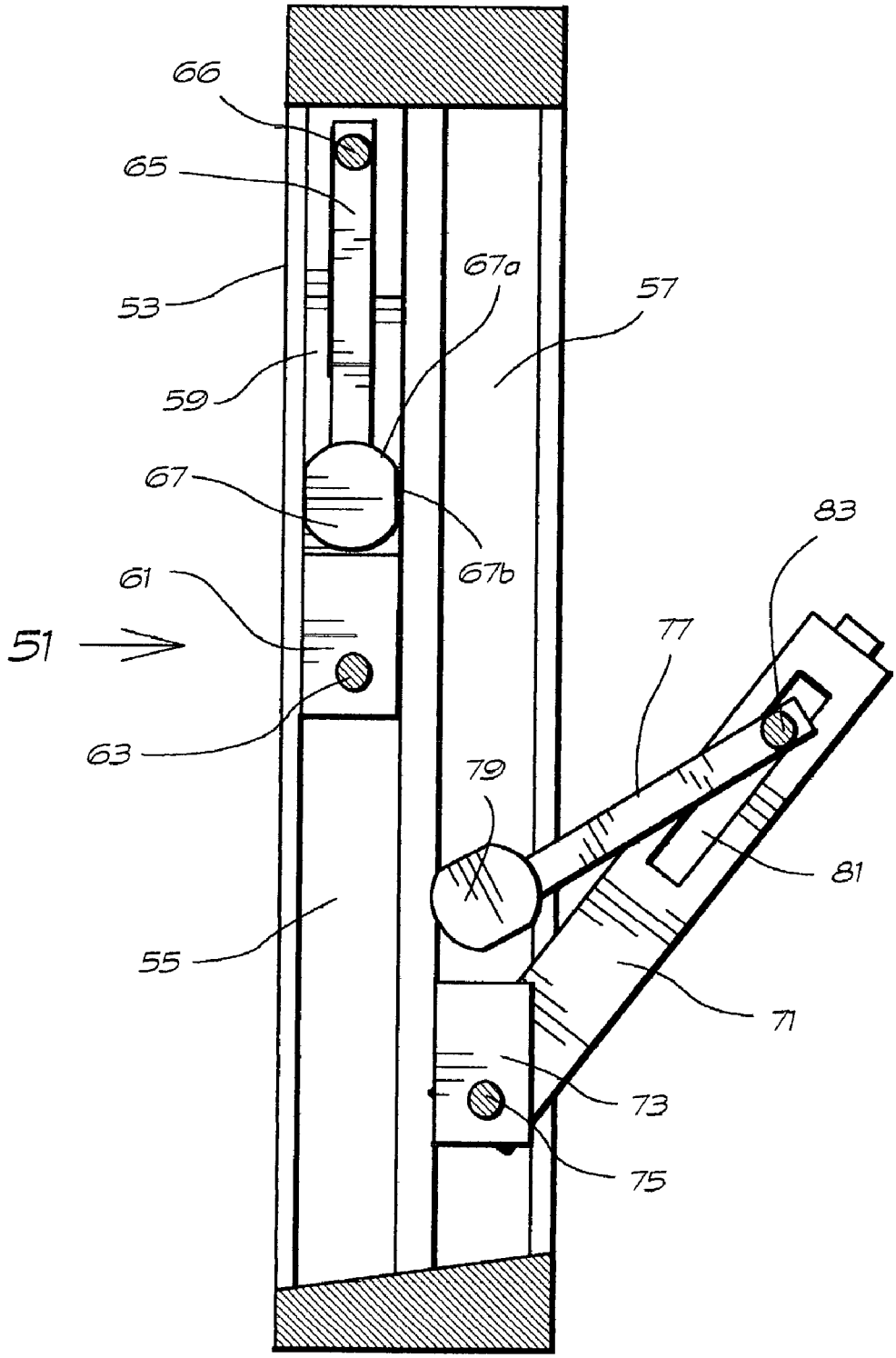

FIG. #. 6.
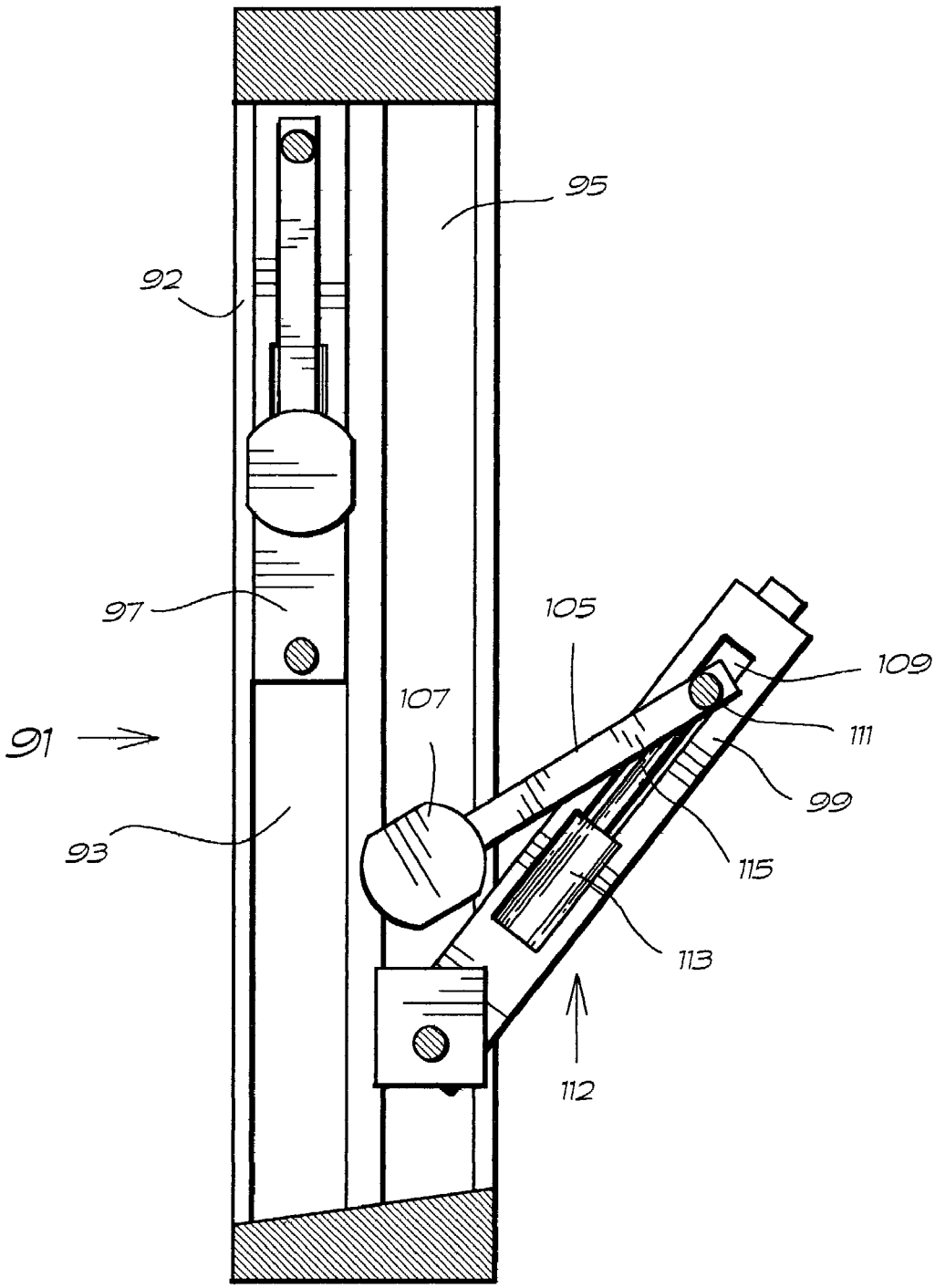

FIG. #. 7.
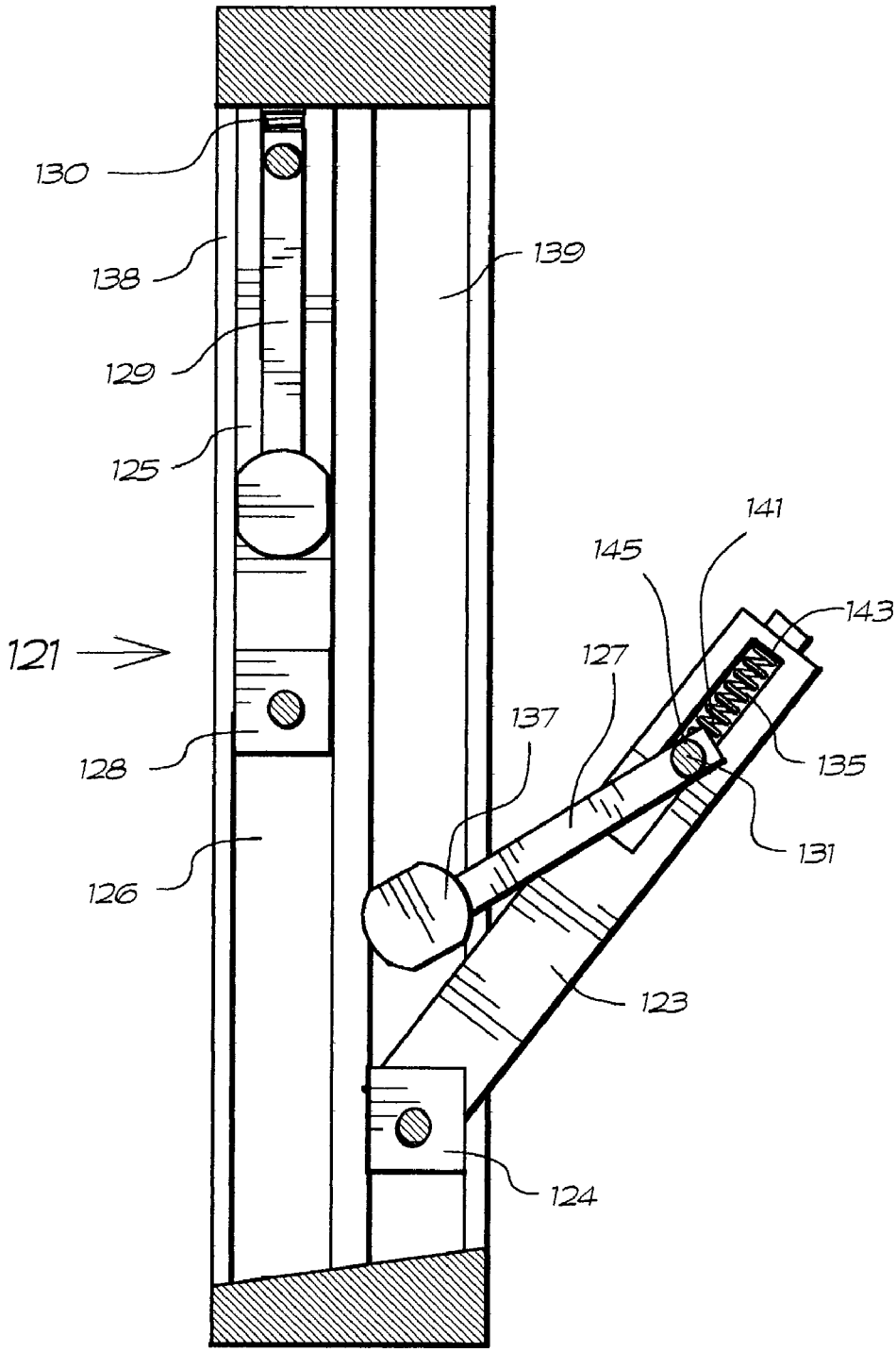

SASH TILT RESISTANCE CONTROL

FIELD OF THE INVENTION

The present invention relates to a tilt control which provides resistance against free fall tilt opening of a tilting sash relative to its supporting frame.

BACKGROUND OF THE INVENTION

Windows with tiltable sashes are known and currently available. The sashes are held at a desired tilt angle by a person cleaning or doing other work on the sash. If that person inadvertently lets go of the sash it will generally fall completely out of the window.

SUMMARY OF THE PRESENT INVENTION

The present invention relates to a window assembly including a tilt control specifically designed to avoid the hazardous problem of a free falling tiltable sash. More specifically, the tilt control of the present invention used in a window assembly comprising a frame and a sash pivotally mounted to the frame provides resistance to the tilt opening of the sash. The resistance provided by the tilt control increases with increased tilt angles of the sash. This compensates for increased force applied on the tilt control by the sash the farther the sash is tilted open.

According to an aspect of the invention the tilt control comprises an arm and spring. The arm has a first end pivotally secured within the frame and a second end engaged within and slideable along the sash. The arm limits the tilt opening of the sash to a tilt angle of less than 90 degrees and the spring, which is acted on by the second end of the arm as it slides along the sash, provides the resistance to the tilt opening of the sash.

BRIEF DESCRIPTION OF THE DRAWINGS

The above as well as other advantages and features of the present invention will be described in greater detail according to the preferred embodiments of the present invention in which;

FIG. 1 is front view of a window assembly having, a frame supporting a pair of sashes including tilt controls for each of the sashes according to a preferred embodiment of the present invention;

FIG. 2 is a perspective view of the window assembly of FIG. 1;

FIG. 3 is sectional view along lines 3—3 of FIG. 1 with the lower sash tilted open to a relatively shallow angle;

FIG. 4 is a view similar to FIG. 3 showing the lower sash tilted open to a steeper angle;

FIG. 5 is a sectional view through a window according to a further preferred embodiment of the present invention;

FIG. 6 is a sectional view through a window according to yet another preferred embodiment of the invention; and FIG. 7 is a sectional view through a window having sash tilt controls according to another embodiment of the invention.

DETAILED DESCRIPTION ACCORDING TO THE PREFERRED EMBODIMENTS OF THE PRESENT INVENTION IN WHICH

FIGS. 1 and 2 show a window assembly generally indicated at 1. This window assembly is formed by a frame comprising side jambs 3, a header 5 and sill 7. Contained within that frame are a pair of sashes 13 and 15.

In FIGS. 1 and 2 both of the sashes are closed relative to the frame. Lock 17 cooperating between the top of the lower sash and the bottom of the upper sash holds them in their closed positions.

As will be described later in detail both of the sashes can be opened in a sliding mode upon release of lock 17 and a tilting mode upon the release of locks 16, 17 and 18.

FIG. 3 shows one of the jambs 3 of the frame as having a pair of channels 9 and 11. The other jamb has the identical construction.

Both of these channels are referred to in the industry as balance channels. Balance channel 9 is located to the interior side of the window i.e., the side of the window facing the interior of a building in which the window is used while balance channel 11 is located to the outer side of the window.

FIG. 3 also shows the mounting of each of the sashes relative to the frame. This mounting is identical to both sides of the window.

More specifically, a rigid slide member 19 is trapped within balance channel 11 while a rigid slide member 31 is trapped within balance channel 9. The lower end of sash 13 is pivotally mounted at 21 to slide member 19 while the lower end of sash 15 is pivotally mounted at 33 to slide member 31. As will be appreciated from FIG. 3, when the lock 17 is released both sashes with their slide members are slideable relative to the frame in their respective channels to provide for the slide opening of the window.

FIGS. 3 and 4 show sash 15 also being openable in the tilting manner relative to the frame. Here it will be seen that when the sash 15 is not locked the upper end of the sash is free to move outwardly and downwardly away from the frame for tilting sash 15 open. Sash 13 has the same capacity. The two sashes can be tilted open one at a time or simultaneously with one another.

Each of the sashes is provided with a tilt control. In the embodiments shown in FIGS. 3 and 4 this tilt control is in the form of an arm and spring combination. Such a combination may be provided to only one side or to both sides of each of the sashes.

More specifically, a rigid arm 37 in combination with a spring 45 is used to control tilting movement of sash 15 to prevent a free falling of this sash from its fully closed to its fully tilted open position. An identical arm and spring combination is used to control sash 13 but because sash 13 is in its closed position only the control arm 23 can be seen in FIGS. 3 and 4.

Again referring to the lower interior sash 15, control arm 37 has a first end pivotally secured at 39 to the rigid slide 31 and a second end in the form of a pivot 41 rotatably and slideably trapped within a slot 43 of sash 15. Also trapped in slot 43 between the first and second ends of arm 37 is a spring 45. In comparing FIGS. 3 and 4 it will be seen that as sash 15 is tilted farther open i.e., moved to increased tilt angles, the pivot end 41 of arm 37 slides inwardly along slot 43 of the sash. At the same time, the pivot end 39 of the arm pivots or rotates relative to slide 31. This produces a compression of spring 45. Once the spring is fully compressed as shown in FIG. 4 the sash has reached its maximum tilt angle of something slightly less than 90 degrees relative to the frame.

Two separate forces counteract one another during the tilt opening of the sash. Firstly, the downward loading of the sash on the control arm increases the farther the sash is tilted open. This is due very simply to the outward levering of the weight of the sash as the sash moves from a more vertical to a more horizontal position i.e., as the upper end of the sash moves downwardly, outwardly away from the frame.

At the same time as the sash is applying more force on the tilt control arm the compression of spring 45 increases to provide increased resistance to the tilt opening of the sash the farther it tilts open. This resistance is not sufficient to prevent the tilt opening of the sash i.e., it will not push the sash back upwardly, but it is sufficient to prevent a free falling of the sash.

As will be apparent from FIGS. 3 and 4 the tilt control i.e., arm 37 and spring 45 do not block sliding of the sash within the frame.

FIG. 5 shows a window assembly generally indicated at 51 with a tilt control which again provides resistance to tilt opening of the window but without the use of a spring.

More specifically, window assembly 51 comprises a frame 53 with balance channels 55 and 57 to the outer and inner sides of the frame. Sashes 59 and 71 are pivotally mounted at 63 and 75 to slide members 61 and 73 in the respective balance channels. Once again, both of the sashes are capable of opening in both a slide and a tilt manner relative to the frame.

Like the earlier embodiment the tilt control includes an arm with an outer end slideably mounted within a slot in each of the sashes. In particular, the inner sash 71 includes an arm 77 having an outer end 83 slideably trapped within slot 81 of the sash. The other sash 59 includes a control arm 65 having an outer end 66 slideably trapped within a slot identical to slot 81 but which cannot be seen because it is covered by the arm.

The two arms 65 and 77 have inner ends formed by cam members 67 and 79 respectively trapped within the balance channels 55 and 57. Each of these cam members has a somewhat elliptical configuration formed by rounded ends and flattened sides. In the case of cam member 67 the rounded ends are indicated at 67*a* and the flattened sides are indicated at 67*b*. Cam member 79 has an identical configuration.

As will be seen in FIG. 5 each of the cam members is relatively long in one dimension and shorter in another dimension. Specifically, each of the cam members is relatively long in the direction running parallel to the flattened side walls and is relatively short in the direction at 90 degrees to the flattened side walls.

In FIG. 5 the upper outwardly located sash 59 is in a fully closed position where it is neither slid nor tilted open. However, in this position because of the orientation of cam member 67 where its flattened side walls 67*b* lie parallel to the length of the balance channel 55, sash 59 is capable of sliding within the balance channel to an open position. It is also capable of tilting open in the same manner as sash 71 is tilted open. However, in the case of sash 71 cam member 79 has been rotated by arm 77 to turn cam member 79 such that its flattened side walls are out of alignment with the length of balance channel 57 with the rounded end walls of the cam member binding against the balance channel. In this position, the cam member provides a resistance to any further tilt opening of the sash counterbalancing the load placed on arm 77 by the sash as the sash is tilted open. Also note that the outer end 83 of arm 77 has slid away from the upper end of slot 81 in sash 71 as the sash is tilted open.

Once again the amount of resistance provided by the binding action of the cam member within the balance channel is not sufficient to prevent the tilt opening of the window. It is however sufficient to prevent a free falling of the window to its fully tilted open position which is at an angle of slightly less than 90 degrees relative to the frame.

When the sash is tilted open as shown in FIG. 5 the tilt control cam not only resists the tilt opening of the window but in addition resists a slide opening of the window to provide both a tilt and a slide control. As such the window should be tilted completely closed before attempting to slide the sash within the frame.

FIG. 6 shows a window assembly generally indicated at 91 having yet another type of tilt control.

More specifically the window assembly comprises a frame 92 having channels 93 and 95. Sashes 97 and 99 are slideably and pivotally mounted in these channels. The tilt controls are identical for both sashes.

As will be best seen with respect to the lower sash, the tilt control comprises an arm 105 having an inner cam end 107 located within channel 95. The arm also has an outer end 111 pivotally secured to a plunger arm 115 which slides in and out relative to a fixed base 113 of a piston like control member 112. The base of control member 112 contains hydraulic fluid through which the plunger arm slowly moves with the tilt opening and closing of the sash. The sash is provided with a slot 109 to provide for the movement of arm 115 relative to the sash.

Once again there is a resistance to the free fall tilt opening of the sash. In this case the resistance is provided by both the cam and the hydraulic piston.

FIG. 7 shows another embodiment of the invention in the form of a window assembly generally indicated at 121. This assembly comprises an inner sash 123 and an outer sash 125. These two sashes are slideably and tiltably held within channels 139 and 126 respectively of a supporting frame 138.

The inner sash includes a tilt control arm 127. The outer sash includes a tilt control arm 129.

Tilt control arm 127 is provided with an outer end pivot 131 slideably trapped within an elongated slot 135 of sash 123. The inner end of arm 127 comprises a cam member 137 rotatably and slidably secured within frame channel 139.

The lower end of sash 123 is held by a slide member 124 in frame channel 139. Slide member 124 like the earlier described embodiments allows both a sliding and tilt opening of sash 123 relative to the supporting frame. A corresponding slide member 128 is used for sash 125.

FIG. 7 shows sash 125 in its tilted closed position with sash 123 in a tilted open position. In this particular case, the resistance to the tilt opening of sash 123 is provided by means of a coil spring 141. This coil spring is trapped within sash slot 135 with the upper outer end of the spring being attached at, 143 to the sash. The inner lower end of spring 141 is attached at 145 to the pivot 131 of control arm 127.

In the FIG. 7 embodiment, the spring 141 rather than being compressed is stretched or expanded relative to its normal or non stressed configuration with the tilt opening of the sash. This stretching of the spring which is biased to pull back to its normal non stretched length provides the resistance needed to prevent a free fall tilt opening of sash 123.

FIG. 7 also shows that the tilt control spring 130 associated with sash 125 is allowed to compress sufficiently for a complete tilt closing of sash 125. The same is true of sash 123.

Although various preferred embodiments of the present invention have been described in detail, it will be appreciated by those skilled in the art that variations may be made without departing from the spirit of the invention or the scope of the appended claims.

What is claimed is:

1. A window assembly comprising a frame and a sash, the sash having a lower end pivotally secured by a sash pivot within the frame and having an upper end releasable from the frame to enable tilt opening of the sash, the sash aligning with the frame when the sash is tilted closed and the upper end of the sash moving downwardly and outwardly away from the frame as the sash is tilted open, said assembly further including a sash tilt control system which comprises an elongated slot in the sash, a control arm having a first end pivotally held by an arm pivot within the frame and having a second end in the slot in the sash, the system further including a spring trapped in the slot in the sash, the second end of the control arm sliding, against resistance from the spring, along the slot as the sash is tilted open, the resistance provided by the spring increasing at increased tilt angles of the sash relative to the frame.

2. A window assembly as claimed in claim 1 wherein said tilt control system limits the tilt opening of said sash to an angle of less than 90 degrees relative to the frame.

3. A window assembly as claimed in claim 1 wherein said arm pivot is located at a distance above said sash pivot in said frame, the distance remaining constant as said sash is tilted open and closed relative to said frame.

4. A window assembly as claimed in claim 3 wherein the frame includes a balance channel and said assembly includes a slide member sildeably held in said balance channel, both said arm pivot and sash pivot being secured in said slide member.

5. A window assembly as claimed in claim 1 wherein said spring comprises a coil spring which is compressed by said second end of said control arm as the sash is tilted open.

* * * * *